US005759227A

United States Patent [19]

Takahashi et al.

[11] Patent Number: 5,759,227

[45] Date of Patent: Jun. 2, 1998

[54] VALVE SEAT FOR INTERNAL COMBUSTION ENGINE

[75] Inventors: Teruo Takahashi; Toshiaki Sato, both of Tochigi-ken, Japan

[73] Assignees: Nippon Piston Ring Co., Ltd.; Honda Giken Kogyo K.K., both of Japan

[21] Appl. No.: 804,969

[22] Filed: Feb. 24, 1997

[30] Foreign Application Priority Data

Feb. 29, 1996 [JP] Japan ..... 8-069319

[51] Int. Cl.[6] ..... C22C 33/00

[52] U.S. Cl. ..... 75/246; 75/231; 75/243; 428/550

[58] Field of Search ..... 75/231, 243, 246; 428/550

[56] References Cited

U.S. PATENT DOCUMENTS

| | | | |
|---|---|---|---|
| 4,204,031 | 5/1980 | Takemura et al. | 428/539.5 |
| 4,233,073 | 11/1980 | Takemura | 75/243 |
| 4,919,719 | 4/1990 | Abe et al. | 75/243 |
| 5,031,878 | 7/1991 | Ishikawa et al. | 251/368 |
| 5,512,080 | 4/1996 | Takahasi et al. | 75/231 |
| 5,529,602 | 6/1996 | Ishii et al. | 75/231 |

FOREIGN PATENT DOCUMENTS 61-117254 6/1986 Japan .

OTHER PUBLICATIONS

English abstract pf Japanese Patent No. J61–117254 Jul. 1986.

*Primary Examiner*—Ngoclan Mai
*Attorney, Agent, or Firm*—Parkhurst & Wendel

[57] ABSTRACT

A valve seat for an internal combustion engine provided with a base member, wherein said base member comprises; a matrix of iron-based alloy comprising (a) carbon in a range of 0.5–1.5 weight % based on weight of said base member, (b) at least one element selected from a group consisting of nickel, cobalt and molybdenum in a range of 2.0–20.0 weight % in total based on weight of said base member and (c) iron as a remainder; cobalt-based hard particles dispersed in said matrix in a range of 26–50 weight % based on weight of said base member.

7 Claims, 8 Drawing Sheets

VALVE SEAT FOR INTERNAL COMBUSTION ENGINE

FIELD OF THE INVENTION

The present invention relates to a valve seat to be used for an internal combustion engine.

BACKGROUND OF THE INVENTION

Many kinds of valve seats including one made of an iron-based sintered alloy have hitherto been used in internal combustion engines such as an automobile engine, and studies have been made as to wear and abrasion resistance of the valve seats.

In general, an engine using a kind of liquid fuels such as gasoline and gas oil has advantage that its valve seat is not easily subject to wear and abrasion resistance, because of maintenance of high lubricity between a valve and the valve seat through the fuel and combustion products including carbon. To the contrary, an operation of an engine using a kind of gaseous fuels such as natural gas leads metallic surfaces of the valve seat and the valve to directly contact with each other because of a smaller amount of combustion products than an amount of thereof in a case where the liquid fuel is used, and hence tends to develop wear and abrasion, resulting in occurrence of a flow caused by plastic deformation and a adhesive wear and abrasion. The valve seat mounted on a exhaust valve side is used under a particularly severe condition, thus leading remarkable wear and/or abrasion.

As to a method to improve wear and abrasion resistance of the valve seat, there is known that hard particles such as Fe—Mo particles and Fe—W particles are dispersed in a matrix of the valve seat. However, when the wear and abrasion resistance of the valve seat is intended to be improved by increasing an amount of the hard particles, the valve which is a counterpart used in combination therewith is liable to be worn and/or abraded.

There have been disclosed some valve seats having excellent wear and abrasion resistance and low attacking property against the counterpart. For example, Japanese Patent Application Laid Open (KOKAI) Nos. HEI 5-43913 discloses a valve seat of iron-based sintered alloy formed by the method in which carbide-dispersed type and/or intermetallic compound-dispersed type hard particles having a Micro Vickers hardness in a range of 500–1800 are dispersed in an amount of 5–25 weight % in the matrix of iron-based sintered alloy, and the shape of the hard particle is made globular. Besides, Japanese Patent Application Laid Open (KOKAI) Nos. HEI 5-43998 discloses another valve seat of iron-based sintered alloy formed by the method in which carbide-dispersed type and/or intermetallic compound-dispersed type hard particles having a Micro Vickers hardness in a range of 500–1800 are dispersed in an amount of 5–25 weight % in the matrix of iron-based sintered alloy to form a base member of the valve seat, and thus formed base member is infiltrated with copper or copper alloy. In the aforesaid publications, however, there is no investigation regarding a countermeasure in case where the valve seat is brought into direct contact between a metallic surface of a counterpart, as in the engine using the gaseous fuel.

SUMMARY OF THE INVENTION

The present invention was made in order to solve the aforementioned problems. An object of the present invention is to provide a valve seat capable of maintaining an excellent wear and abrasion resistance and low attacking property against the counterpart, even when it is used under a severe condition, such as a condition which leads easy occurrence of direct contact between a metallic surfaces of a valve and the valve seat, as used for example, in an engine using the gaseous fuel.

According to the present invention, for the purpose of achieving the aforementioned object, there is provided a valve seat for an internal combustion engine provided with a base member, wherein said base member comprises;

a matrix of an iron-based alloy comprising (a) carbon in a range of 0.5–1.5 weight % based on weight of said base member, (b) at least one element selected from a group consisting of nickel, cobalt and molybdenum in a range of 2.0–20.0 weight % in total based on weight of said base member and (c) iron as a remainder, and cobalt-based hard particles dispersed in said matrix in a range of 26–50 weight % based on weight of said base member.

Because the cobalt-based hard particles used in the present invention are different from the conventional hard particles (i.e., Fe—Mo hard particles, Fe—W hard particles and the like) in that they have high attacking property against a counterpart and has a self-lubricity, it is possible to control the attacking property against the counterpart within a low level even when the cobalt-based hard particles are dispersed in the base member of the valve seat in a large amount of 26–50 weight %. Therefore, the valve seat according to the present invention is able to maintain an excellent wear and abrasion resistance and a low attacking property against the counterpart even under severe operating conditions, particularly, under a condition which leads easy occurrence of the direct contact between the metallic surfaces of the valve and the valve seat, as used in the engine using the gaseous fuel.

DETAILED DESCRIPTION OF THE PREFERRED EMBODIMENTS

Figure 1:
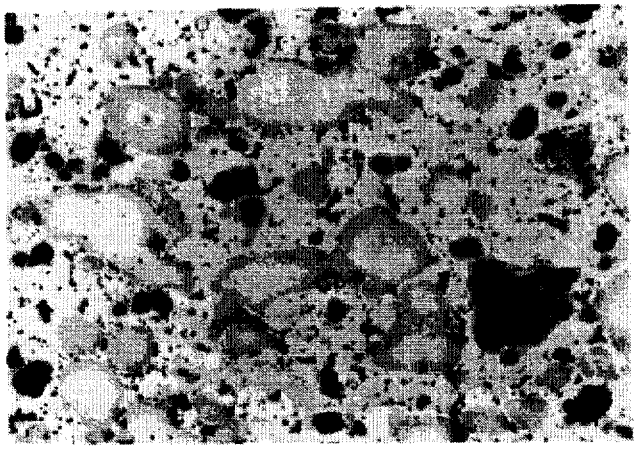
FIG. 1 is a photograph showing a metallographic structure of a valve seat obtained in Example 2 of the present invention.

An embodiment of the present invention will be described hereinafter. A valve seat of the present invention is provided with a base member as a main body. The base member has a metallographic structure comprising a matrix of iron-based alloy and cobalt-based hard particles dispersed in the matrix. Essential components of the matrix are (a) carbon(C), (b) one or more kind of elements selected from the group consisting of nickel(Ni), cobalt(Co) and molybdenum(Mo), and (c) iron(Fe). For each aforementioned component, a content based on a total weight of the base member is as follows.

(1) The content of carbon defined as the component of the matrix is in a range of from 0.5 to 1.5 weight %, and it is preferable to limit a lower limit thereof to not less than 0.8 weight % and an upper limit thereof to not more than 1.2 weight %.

(2) The total content of nickel, cobalt and molybdenum respectively defined as the component of the matrix is in a range of from 2.0 to 20.0 weight %, and it is preferable to limit a lower limit thereof to not less than 5 weight % and an upper limit thereof to not more than 15 weight %.

(3) The content of the cobalt-based hard particles is in a range of from 26 to 50 weight %, and it is preferable to limit a lower limit thereof to not less than 30 weight % and an upper limit thereof to not more than 40 weight %.

(4) A remainder of the base member is iron defined as the component of the matrix. For all that, the remainder may include unavoidable impurities.

As to the amount of carbon defined as the component of the matrix, if the amount of carbon is smaller than 0.5 weight %, free ferrite may be precipitated in the matrix, thus causing an obstruction to the wear and abrasion resistance. Besides, when the base member is formed of iron-based sintered alloy, the excessively small amount of carbon may cause an insufficient diffusion during sintering process. On the other hand, if the amount of carbon is larger than 1.5 weight %, free cementite may be precipitated in the matrix, causing a deterioration of machinability during cutting process.

As to the total amount of nickel, cobalt and molybdenum respectively defined as the component or the ingredient of the matrix, if the total amount of them is smaller than 2.0 weight %, there may be caused an insufficient strengthening of the matrix or an insufficient heat resistance thereof. On the other hand, if the aforesaid total amount is larger than 20.0 weight %, retained austenite may be formed, and besides, the cost for the production of the valve seat is raised.

As to the amount of the cobalt-based hard particles, if its amount is smaller than 26 weight %, the cobalt-based hard particles could not sufficiently contribute to improvement of the wear and abrasion resistance. Particularly, in a case where the metallic surfaces of the valve and the valve seat is mostly brought into direct contact with each other, for example, in a case of the engine using alternative fuels such as natural gas, the wear and abrasion resistance is liable to be insufficient by the excessively small amount of the cobalt-based hard particles. On the other hand, if the amount of the cobalt-based hard particles is larger than 50 weight %, bonding strength between the particles may be decreased, and besides, the cost for the production of the valve seat is raised.

The cobalt-based hard particles used in the present invention are an intermetallic compound, which include cobalt as a main component and another element (for example, molybdenum (Mo), chromium (Cr) and nickel (Ni)) capable of improving the heat resistance and/or the corrosion resistance, and have a Vickers hardness of not less than Hv 500, preferably not less than Hv 700. An average particle diameter of the cobalt-based hard particles is usually in the range of from 50 to 200 μm, preferably in the range of from 100 to 150 μm. The cobalt-based hard particles preferably have globular shapes. Concrete product names of the aforesaid cobalt-based hard particles may include "TRIBALOY T-400" and "TRIBALOY T-800" respectively manufactured by NIKKOSHI Co., Ltd.

In the present invention, one or more kinds of self-lubricating materials may be dispersed in the base member of the valve seat. Addition of the self-lubricating material prevents the metallic surface of the valve seat from being brought into direct contact with the metallic surface of the valve, making it possible to improve extents of the wear and abrasion resistance and the attacking property against the counterpart. Examples of the self-lubricating materials may include; sulfides such as MnS and $MoS_2$; fluorides such as $CaF_2$; nitrides such as BN; and graphite. A content of the self-lubricating material is usually in a range of from 0.5 to 5 weight %, preferably in a range of from 2 to 3 weight %, based on the total weight of the base member. If a content thereof is smaller than 0.5 weight %, the self-lubricating material can not sufficiently contribute to improvement of the self-lubricity. On the other hand, a content thereof is larger than 5 weight %, the wear and abrasion resistance may be liable to be decreased due to a decrease in bonding strength between the particles and a decrease in strength of the base member.

The valve seat of the present invention may be formed of iron-based sintered alloy. When the valve seat is intended to be formed of the iron-based sintered alloy, a hardening treatment can optionally be omitted. In this case, as powdery raw material for the matrix, there may be used; for example, powder of the iron-based alloy; powder including the iron-based alloy as a main component; or non-alloyed powder which is prepared by blending pure-iron powder and powder of an element other than iron for a component of the matrix. Particularly, the use of the non-alloyed powder improves compaction ability, and gives an advantage in a cost of the raw material. When the non-alloyed powder is used as the powdery raw material for the matrix, a valve seat obtained therefrom usually has a metallographic structure in which a pearlite phase, a martensite phase and a highly alloyed phase are messily concurrent with each other.

According to the present invention, the aforementioned "highly alloyed phase" is a portion of an austenite phase in which nickel, cobalt and molybdenum respectively described above as the components of the matrix diffuse at high concentration, and which has a high hardness, preferably in a range of from Hv 500 to Hv 700. As to an amount ratio of each phase to the matrix, there can be expressed by an area ratio based on an area of the matrix portion in a cross section of the base member. When the area of the matrix portion given by subtracting an area of the hard particles portion from the cross section of the base member is defined as 100% by area, the area ratio of each phase is as follows; the portion of the pearlite phase being in a range of from 30 to 60%, the portion of the martensite phase being in a range of from 5 to 15%, and the portion of the highly alloyed phase being in a range of from 30 to 60%; and preferably, the portion of the pearlite phase being in a range of from 40 to 50%, the portion of the martensite phase being in a range of from 5 to 10%, and the portion of the highly alloyed phase being in a range of from 40 to 50%.

When the base member of the valve seat is formed of the sintered alloy, any metal having a low melting point may be infiltrated into pores of the base member. Because the thus infiltrated metal having a low melting point interposes between the valve and the valve seat to function as a lubricant, it prevents the direct contact between the metallic surfaces of the valve and the valve seat, thus imparting improved wear and abrasion resistance and low attacking property against the counterpart to the valve seat. Examples of the metal having a low melting point may include lead (Pb), zinc (Zn), tin (Sn), copper (Cu) and an alloy including at least one element selected from those.

The sintered alloy usually has a porosity in a range of from 5 to 20%, preferably in a range of from 10 to 15%. If the porosity is smaller than 5%, an amount of the infiltrated metal having a low melting point may be insufficient. On the other hand, if the porosity is larger than 20%, the wear and abrasion resistance may be liable to be decreased due to the decrease in bonding strength between the particles and the decrease in strength of the base member.

TABLE 1 shows a chemical composition of one embodiment of the valve seat according to the present invention. The chemical composition of TABLE 1 is that of the base member obtained after the Pb-infiltration, more specifically, obtained by forming the base member of iron-based sintered alloy from the raw material for the matrix and the cobalt-based hard particles, and subsequently infiltrating lead(Pb) into the base member. The chemical composition showed in TABLE 1 is out of accord with a chemical composition of the matrix permitted in the present invention, because the components included in the cobalt-based hard particles effect on the chemical composition.

TABLE 1

| Element of Component | Chemical Composition (WT. %) |
|---|---|
| C | 0.5–1.5 |
| Si | 0.2–2.0 |
| Cr | 1.0–10.0 |
| Mo | 5.0–20.0 |
| Ni | 2.0–10.0 |
| Co | 10.0–45.0 |
| Pb | 10.0–20.0 |
| Unavoidable Components | Not More Than 2.0 |
| Fe | Remainder |

EXAMPLES

Now, the present invention will be described hereinafter in more detail with reference to Experiment Examples and Comparative Examples.

EXAMPLE 1

Experiment Example

A powdery raw material was prepared through the method in which pure-iron powder and powder composed of plural kinds of powders other than the pure-iron powder were respectively taken out, and the latter powder was added into the former powder, and subsequently, thus obtained powder was subjected to a mixing treatment by means of a V-shaped mixer for 10 minutes. The pure-iron powder included less than 0.020 wt. % of C and 0.10–0.35 wt. % of Mn as unavoidable impurities. The latter powder to be mixed with the pure-iron powder was previously prepared so as to obtain the following composition based on the total weight of the powdery raw material;

C: 1.0 wt. %

Ni: 6.0 wt. %

Co: 4.0 wt. %

Mo: 2.0 wt. %

30.0 wt. % of the cobalt-based hard particles ("TRIBALOY T-800" manufactured by NIKKOSHI Co., Ltd.), which included not more than 0.08 wt. % of C, 28.5 wt. % of Mo, 17.5 wt. % of Cr and 3.4 wt. % of Si respectively based on the weight of the cobalt-based hard particles, and a remainder of Co, and 1.0 wt. % of zinc stearate as a lubricant.

Then, the aforesaid powdery raw material was subjected to a compression molding so as to obtain a green compact having a shape corresponding to the valve seat. Thereafter, the thus obtained green compact was subjected to a sintering treatment by means of an AX gas furnace at 1160° C. for 45 minutes, and subsequently, it was cooled at a cooling rate of 400° C./hour, whereby manufacturing the valve seat formed of the sintered alloy.

EXAMPLES 2 to 6

Experiment Examples and

EXAMPLES 7 to 10

Comparative Examples

The valve seat of each examples was manufactured in the same manner as in EXAMPLE 1 except that the kind and the amount of the hard particles were changed, and $CaF_2$ as the self-lubricating material was added into the powdery raw material according to an occasional demand. In some examples, a sintered compact obtained through the sintering and cooling process was placed in a vacuum vessel so that air was discharged from pores of the sintered compact, thereafter, the sintered compact was dipped into fused Pb and was put under pressure to be infiltrated with Pb as the self-lubricating material, whereby manufacturing the valve seat. Components and an amount of each of them are shown in TABLE 2 below.

TABLE 2

| Number of Example | Composition (weight %) Component Of Matrix C | Ni | Co | Mo | Fe | Hard Particle | | Lubricant | |
|---|---|---|---|---|---|---|---|---|---|
| 1 (experiment) | 1.0 | 6.0 | 4.0 | 2.0 | remainder | Co—based | 30 | non | — |
| 2 (experiment) | 1.0 | 6.0 | 4.0 | 2.0 | remainder | Co—based | 40 | non | — |
| 3 (experiment) | 1.0 | 6.0 | 4.0 | 2.0 | remainder | Co—based | 30 | $CaF_2$ | 3 |
| 4 (experiment) | 1.0 | 6.0 | 4.0 | 2.0 | remainder | Co—based | 40 | $CaF_2$ | 3 |
| 5 (experiment) | 1.0 | 6.0 | 4.0 | 2.0 | remainder | Co—based | 30 | Pb infiltration | — |
| 6 (experiment) | 1.0 | 6.0 | 4.0 | 2.0 | remainder | Co—based | 40 | Pb infiltration | — |
| 7 (comparative) | 1.0 | 6.0 | 4.0 | 2.0 | remainder | Co—based | 10 | non | — |
| 8 (comparative) | 1.0 | 6.0 | 4.0 | 2.0 | remainder | Co—based | 20 | non | — |
| 9 (comparative) | 1.0 | 6.0 | 4.0 | 2.0 | remainder | *FeW—based | 40 | non | — |
| 10 (comparative) | 1.0 | 6.0 | 4.0 | 2.0 | remainder | FeMo—based | 40 | non | — |

Notes:
FeW— and FeMo— based hard particles are conventionally applied to the valve seat for the gasoline engine.

Investigation method for the wear and abrasion resistance

The valve seat obtained in accordance with each example was subject to a durability test with the use of a straight-type, four cycle, natural gas engine having four cylinders and displacement of 2000 cc. The test was made at 6000 rpm/WOT (full throttle) for 24 hour. A valve as the counterpart was formed of heat-resisting steel "SUH35" as a base material, and had a surface of valve face on which stellite overlay was formed. The wear and abrasion resistance was evaluated by measuring an amount of wear and abrasion after the durability test with respect to the valve and the valve seat on an exhaust port whose condition was severer than that of an intake port. Evaluation results are shown in Table 3 below.

TABLE 3

| Number of EXAMPLE | Amount of Wear And Abrasion | |
|---|---|---|
| | Valve Seat (μ/Hr) | Valve (μ/Hr) |
| Experiment Example | | |
| 1 | 0.58 | 0.11 |
| 2 | 0.43 | 0.15 |
| 3 | 0.51 | 0.07 |
| 4 | 0.40 | 0.08 |
| 5 | 0.42 | 0.13 |
| 6 | 0.35 | 0.16 |
| Comparative Example | | |
| 7 | 1.42 | 0.08 |
| 8 | 0.84 | 0.11 |
| 9 | 3.42 | 2.12 |
| 10 | 2.98 | 1.87 |

In TABLE 3, according as the amount of the cobalt-based hard particles is increased, the abrasion loss is decreased (i.e., EXAMPLE 7→8→1→2). TABLE 3 further shows the effect of $CaF_2$ (i.e., EXAMPLE 1→3 and 2→4) and the effect of Pb infiltration (i.e., EXAMPLE 1→5 and 2→6). On the other hand, when the hard particles of FeW or FeMo conventionally used for the gasoline engine were added at 40 weight %, an excessive wear and abrasion was caused in the valve and the valve seat (i.e., EXAMPLE 9→10).

Explanation for metallographic structures

With respect to EXAMPLES 2, 3, 7 and 10, photographs of metallographic structures are respectively showed in FIGS. 1, 3, 5 and 7. Photographing was performed under a condition of nital corrosion (4%) at 100 times of magnification.

Figure 2:
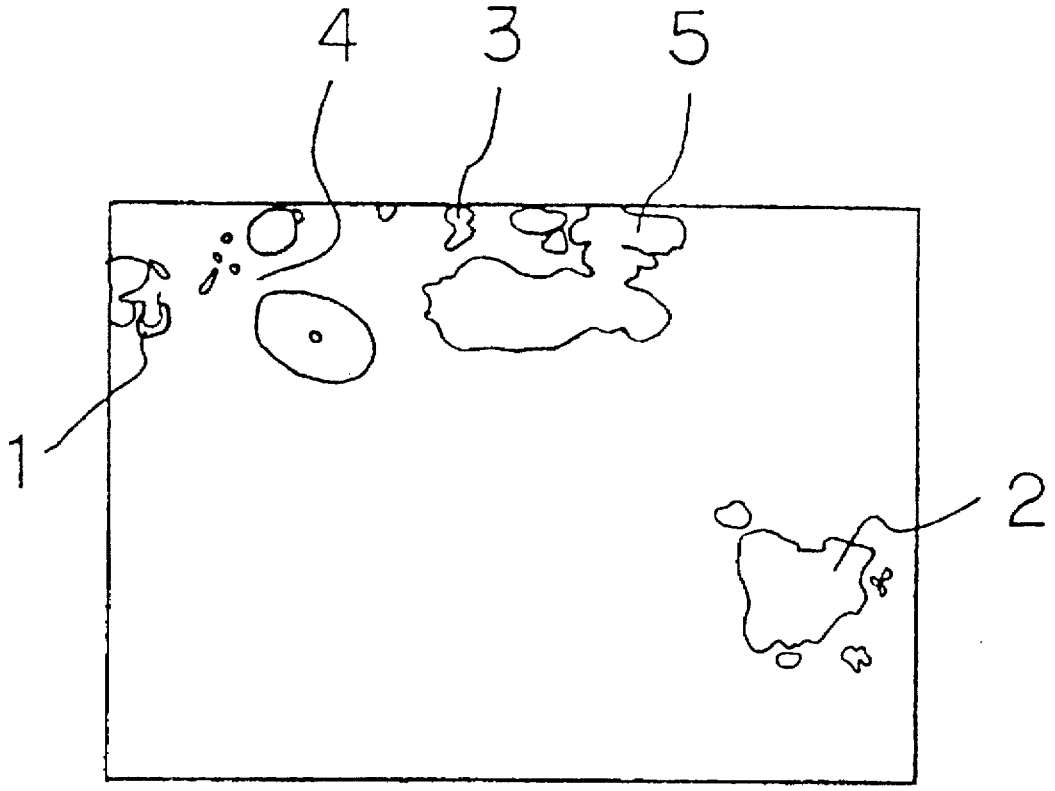
FIG. 2 is a schematic view explaining the photograph of FIG. 1.

The photograph of FIG. 1 (EXAMPLE 2 of the experiment example) is schematically shown in FIG. 2. In FIG. 1, small black dots express the pores 1; black areas express the pearlite phase 2, but partly express the martensite phase 3; and, white areas express the highly alloyed phase 4. Besides, white spots express the cobalt-based hard particles, which are added to the base member at a ratio of 40 weight %, and dispersed therein.

Figure 3:
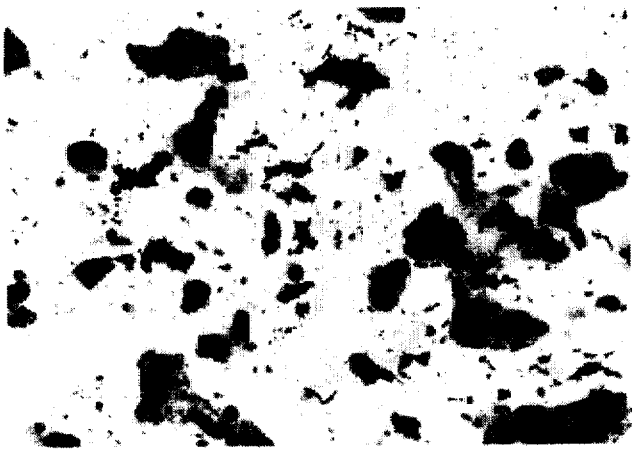
FIG. 3 is a photograph showing a metallographic structure of a valve seat obtained in Example 3 of the present invention.
Figure 4:
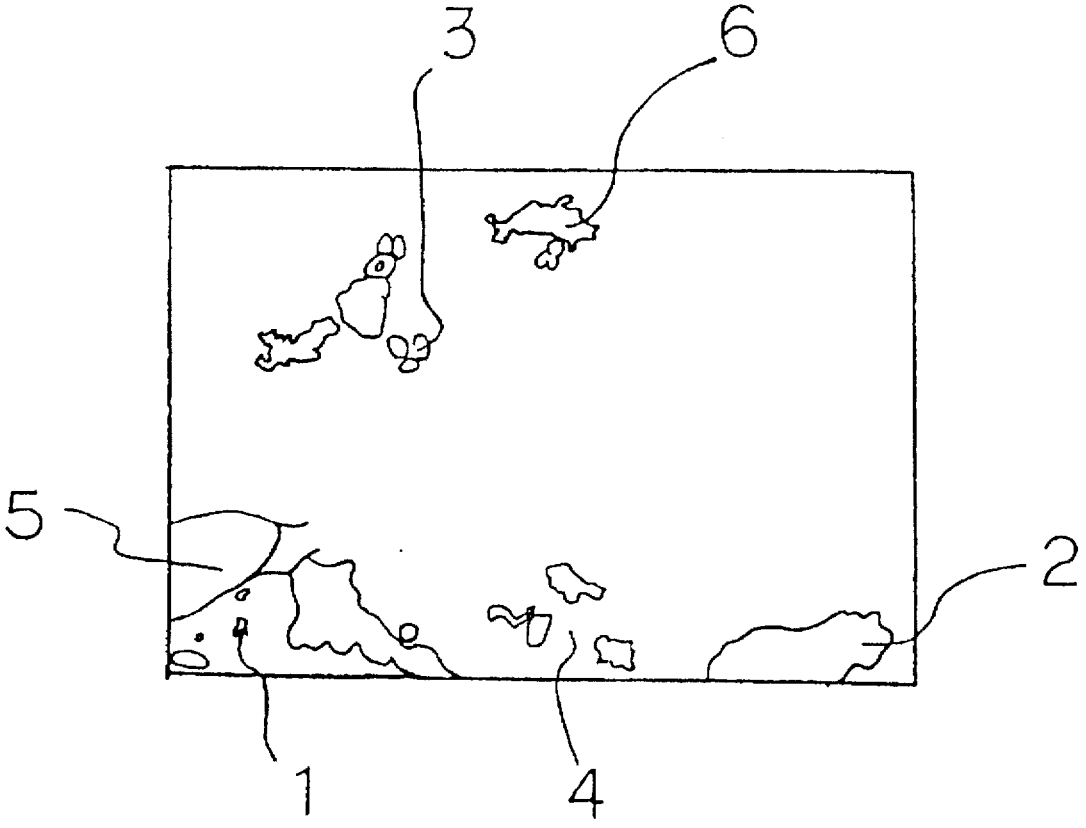
FIG. 4 is a schematic view explaining the photograph of FIG. 3.

The photograph of FIG. 3 (EXAMPLE 3 of the experiment example) is schematically shown in FIG. 4. In FIG. 3, small black dots express the pores 1; and another black dots larger than the pores express $CaF_2$ (6) as the self-lubricating material. The matrix in FIG. 3 has a structure in which the pearlite phase 2 (black area), the martensite phase 3 (also, black area) and the highly alloyed phase 4 (white area) exist in a mixed state. The cobalt-based hard particles 5 expressed as white spots are added to the base member at a ratio of 30 weight %, and dispersed therein.

Figure 5:
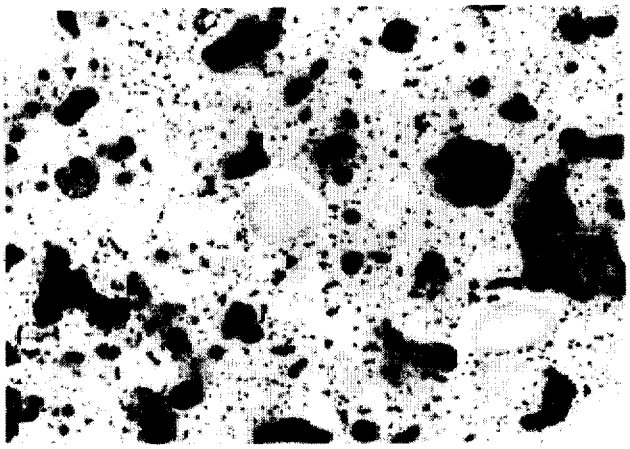
FIG. 5 is a photograph showing a metallographic structure of a valve seat obtained in Example 7 as a comparative example.
Figure 6:
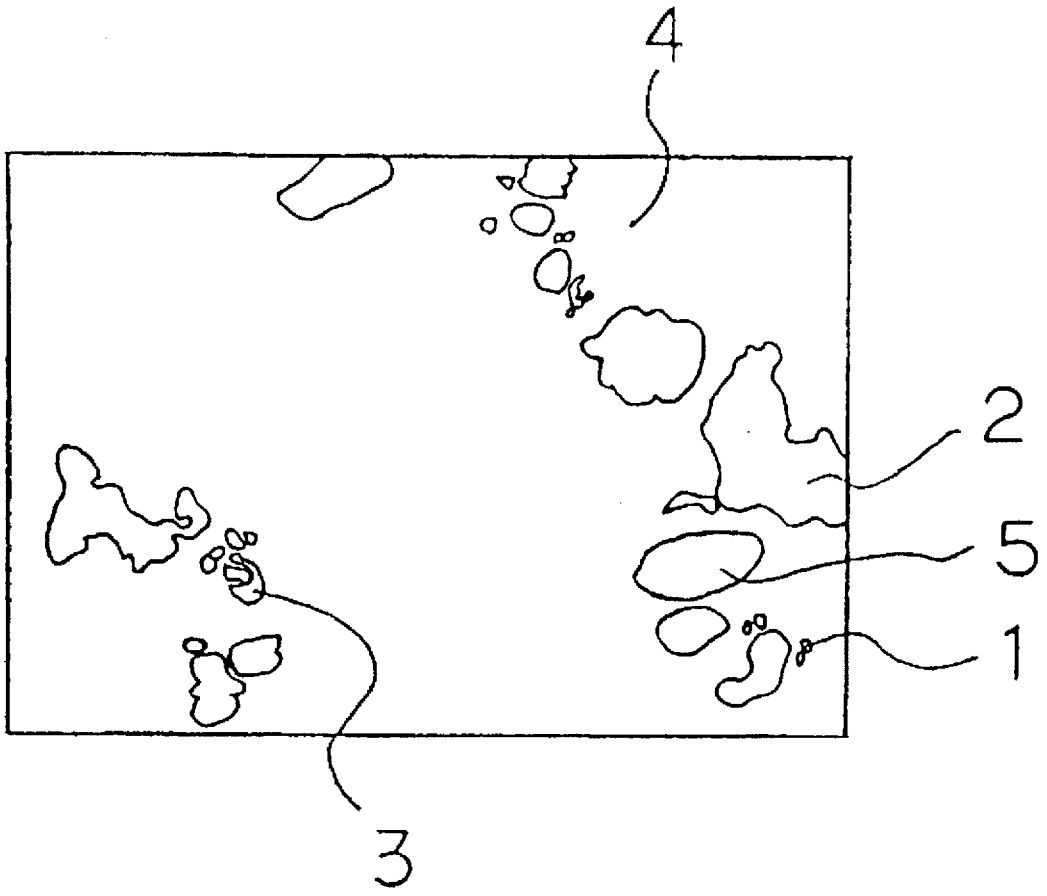
FIG. 6 is a schematic view explaining the photograph of FIG. 5.

The photograph of FIG. 5 (EXAMPLE 7 as the comparative example) is schematically shown in FIG. 6. In this case, the amount of the cobalt-based hard particles 5 (corresponding to the white spots) is 10 weight %, and it is smaller than that in case of FIG. 1 (refer to EXAMPLE 2)

Figure 7:
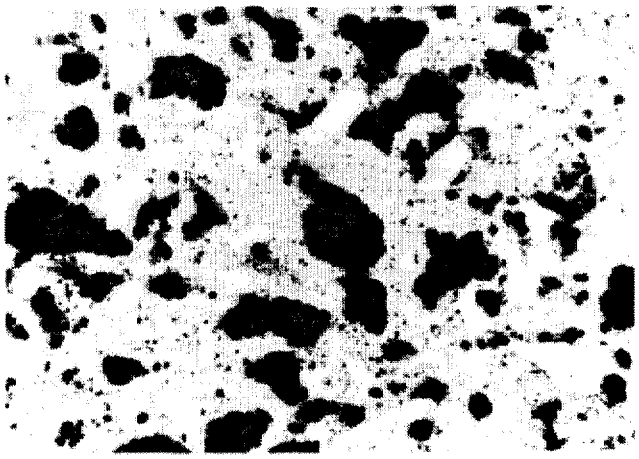
FIG. 7 is a photograph showing a metallographic structure of a valve seat obtained in Example 10 as a comparative example.
Figure 8:
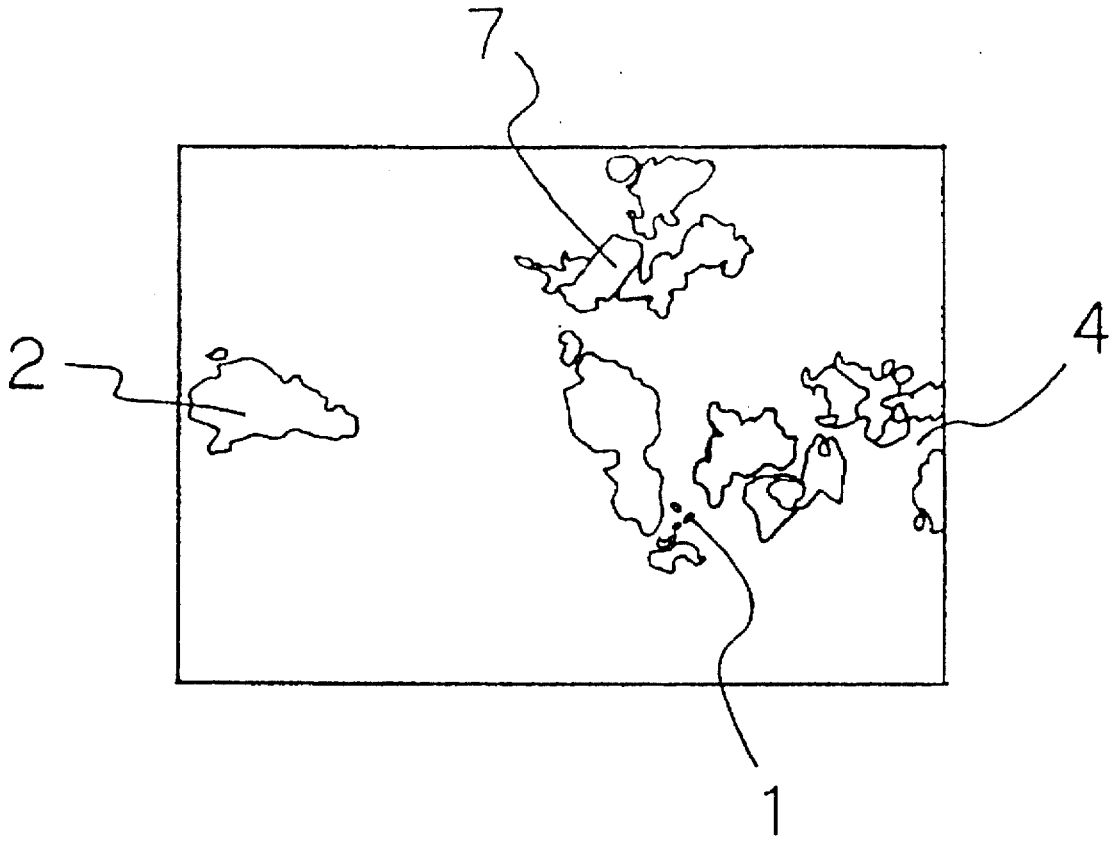
FIG. 8 is a schematic view explaining the photograph of FIG. 7.

The photograph of FIG. 7 (EXAMPLE 10 as the comparative example) is schematically shown in FIG. 8. The matrix in FIG. 7 has a structure in which the pearlite phase 2 (black area) and the highly alloyed phase 4 (white area) exist in a mixed state. Another white portions express Fe—Mo hard particles 7, which are added to the base member at a ratio of 40 weight %, and dispersed therein.

As the valve seat of the present invention for the internal combustion engine has a remarkably low attacking property against the counterpart as well as an excellent wear and abrasion resistance, it is preferably applied to various internal combustion engines. Particularly, the valve seat of the present invention is preferably used; in case of an internal combustion engine leading easy occurrence of wear and abrasion through a direct contact between metallic surfaces, as in the gaseous fuel—engine; or in case that the valve seat is used in combination with the valve of the exhaust port.

What is claimed is:

1. A valve seat for an internal combustion engine provided with a base member, wherein said base member comprises;

a matrix of an iron-based alloy comprising (a) carbon in a range of 0.5–1.5 weight % based on weight of said base member, (b) at least one element selected from a group consisting of nickel, cobalt and molybdenum in a range of 2.0–20.0 weight % in total based on weight of said base member and (c) iron as a remainder of said matrix, and cobalt-based hard particles dispersed in said matrix in a range of 26–50 weight % based on weight of said base member.

2. A valve seat for an internal combustion engine as claimed in claim 1, wherein, said matrix is iron-based sintered alloy.

3. A valve seat for an internal combustion engine as claimed in claim 2, wherein, said matrix is formed from non-alloyed powdery raw material comprising iron powder and elements as components of said matrix other than iron, and has a structure in which pearlite, martensite and a highly alloyed phase exist in a mixed state.

4. A valve seat for an internal combustion engine as claimed in claim 2, wherein, said base member has a porosity in a range of 5–20% and whose pores are infiltrated with metal having a low melting point.

5. A valve seat for an internal combustion engine as claimed in claim 1, wherein, said base member further comprises a self-lubricating material dispersed in said matrix.

6. A valve seat for an internal combustion engine as claimed in claim 1, wherein, said valve seat is to be applied to a internal combustion engine using a gaseous fuel.

7. A valve seat for an internal combustion engine as claimed in claim 1, wherein, said valve seat is to be used as a valve seat for a exhaust valve.

* * * * *